US010627137B2

(12) United States Patent
Swab

(10) Patent No.: US 10,627,137 B2
(45) Date of Patent: Apr. 21, 2020

(54) FUEL REGENERATION USING WASTE HEAT OF REFRIGERATION UNIT

(71) Applicant: Carrier Corporation, Jupiter, FL (US)

(72) Inventor: Michael Swab, Acworth, GA (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 173 days.

(21) Appl. No.: 15/111,225

(22) PCT Filed: Jan. 13, 2015

(86) PCT No.: PCT/US2015/011114
§ 371 (c)(1),
(2) Date: Jul. 13, 2016

(87) PCT Pub. No.: WO2015/106238
PCT Pub. Date: Jul. 16, 2015

(65) Prior Publication Data

US 2016/0334146 A1 Nov. 17, 2016

Related U.S. Application Data

(60) Provisional application No. 61/926,545, filed on Jan. 13, 2014.

(51) Int. Cl.
*F25B 27/00* (2006.01)
*F02M 21/02* (2006.01)
(Continued)

(52) U.S. Cl.
CPC ..... *F25B 27/00* (2013.01); *F02M 21/0215* (2013.01); *F02M 21/06* (2013.01);
(Continued)

(58) Field of Classification Search
None
See application file for complete search history.

(56) References Cited

U.S. PATENT DOCUMENTS 3,986,340 A * 10/1976 Bivins, Jr. ..... F17C 9/02 122/33
4,331,129 A 5/1982 Hong et al.
(Continued)

FOREIGN PATENT DOCUMENTS

CN 102423997 A 4/2012
JP 2006264568 A * 10/2006 ..... B60H 1/00271
(Continued)

OTHER PUBLICATIONS

Notification of Transmittal of the International Search Report and the Written Opinion of the International Searching Authority, Application No. PCT/US2015/011114; dated Apr. 24, 2015; 12 pages.

*Primary Examiner* — Edward F Landrum
*Assistant Examiner* — Daniel C Comings
(74) *Attorney, Agent, or Firm* — Cantor Colburn LLP

(57) ABSTRACT

A refrigerated transportation cargo container includes a container and a refrigeration unit to provide a flow of refrigerated supply air for the container. The refrigeration unit has refrigerant flowing there through and includes a compressor and an engine (36) powered by a flow of fuel and driving the compressor. A regeneration heat exchanger (50) gasifies the fuel prior to the fuel entering the engine via a thermal energy exchange with the refrigerant flowing through the regeneration heat exchanger. A method of operating a refrigeration unit includes connecting an engine to a compressor and enabling a flow of refrigerant through the refrigeration unit. The refrigerant is directed through a regeneration heat exchanger as a flow of liquid fuel. The fuel is gasified at the regeneration heat exchanger via a thermal energy exchange with the refrigerant. The gasified fuel is directed to the engine to power the engine.

12 Claims, 2 Drawing Sheets

(51) Int. Cl.

| | |
|---|---|
| ***F02M 21/06*** | (2006.01) |
| ***F28D 15/00*** | (2006.01) |
| ***F25D 11/00*** | (2006.01) |
| ***F28F 27/00*** | (2006.01) |
| *F28D 21/00* | (2006.01) |

(52) U.S. Cl.

CPC ..... *F25D 11/003* (2013.01); *F28D 15/00* (2013.01); *F28F 27/00* (2013.01); *F25B 2327/001* (2013.01); *F28D 2021/0026* (2013.01); *F28D 2021/0068* (2013.01); *F28F 2265/16* (2013.01)

(56) References Cited

U.S. PATENT DOCUMENTS

| | | | | |
|---|---|---|---|---|
| 4,526,012 | A * | 7/1985 | Chigira | F25B 49/022 62/196.3 |
| 7,493,763 | B2 | 2/2009 | Klochko et al. | |
| 8,069,677 | B2 | 12/2011 | Faka | |
| 8,196,413 | B2 | 6/2012 | Mak | |
| 9,776,702 | B2 * | 10/2017 | Kang | B63H 21/38 |
| 2003/0005698 | A1 | 1/2003 | Keller | |
| 2007/0044485 | A1 | 3/2007 | Mahl | |
| 2008/0110091 | A1 | 5/2008 | Perkins et al. | |
| 2009/0211263 | A1 | 8/2009 | Coyle | |
| 2009/0226308 | A1 | 9/2009 | Vandor | |
| 2010/0146971 | A1 | 6/2010 | Mak | |
| 2011/0167824 | A1 | 7/2011 | Mak | |

FOREIGN PATENT DOCUMENTS

| | | | |
|---|---|---|---|
| JP | 5155471 | B1 * | 3/2013 |
| JP | 2013234973 | A | 11/2013 |
| WO | 2005043032 | A1 | 5/2005 |
| WO | 2013130557 | A1 | 9/2013 |
| WO | 2011032556 | A1 | 7/2016 |

* cited by examiner

FUEL REGENERATION USING WASTE HEAT OF REFRIGERATION UNIT

BACKGROUND OF THE INVENTION

The subject matter disclosed herein relates to refrigeration systems. More specifically, the subject matter disclosed herein relates to refrigeration of containers utilized to store and ship cargo.

A typical refrigerated cargo container or refrigerated truck trailer, such as those utilized to transport a cargo via sea, rail or road, is a container modified to include a refrigeration unit located at one end of the container. The refrigeration unit includes a compressor, condenser, expansion valve and evaporator serially connected by refrigerant lines in a closed refrigerant circuit in accord with known refrigerant vapor compression cycles. A power unit, including an engine, drives the compressor of the refrigeration unit, and is typically diesel powered, or in other applications natural gas powered. In many truck/trailer transport refrigeration systems, the compressor is driven by the engine shaft either through a belt drive or by a mechanical shaft-to-shaft link. In other systems, the engine drives a generator that generates electrical power, which in turn drives the compressor.

As stated above, diesel fuel is typically utilized to power the engine. Alternatives such as compressed natural gas (CNG) and liquid natural gas (LNG) are used as engine fuel sources in some systems. CNG-fueled systems have difficulties, however, with containment of the high-pressure CNG, as well as the relatively low energy output of the CNG fuel. LNG is often more cost effective than diesel, but the LNG must be heated to gasify, or regenerate, the LNG into gaseous methane prior to introduction of the fuel into the engine. This regeneration is typically achieved by use of an electric heater in the fuel system, or by utilizing waste heat from the engine to gasify the methane LNG.

BRIEF DESCRIPTION OF THE INVENTION

In one embodiment, a refrigerated transportation cargo container includes a transportation cargo container and a refrigeration to provide a flow of supply air for the transportation cargo container. The refrigeration unit has a flow of refrigerant flowing there through and includes a compressor and an engine powered by a flow of fuel and operably connected to the compressor to drive the compressor. A regeneration heat exchanger is utilized to gasify the flow of fuel prior to the flow of fuel entering the engine via a thermal energy exchange with the flow of refrigerant flowing through the regeneration heat exchanger.

In another embodiment, a method of operating a refrigeration unit for a refrigerated transportation cargo container includes operably connecting an engine to a compressor of the refrigeration unit and flowing a flow of refrigerant through the refrigeration unit. The flow of refrigerant is directed through a regeneration heat exchanger and a flow of liquid fuel is directed through the regeneration heat exchanger. The flow of fuel is gasified at the regeneration heat exchanger via a thermal energy exchange with the flow of refrigerant. The gasified flow of fuel is directed to the engine to power the engine.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
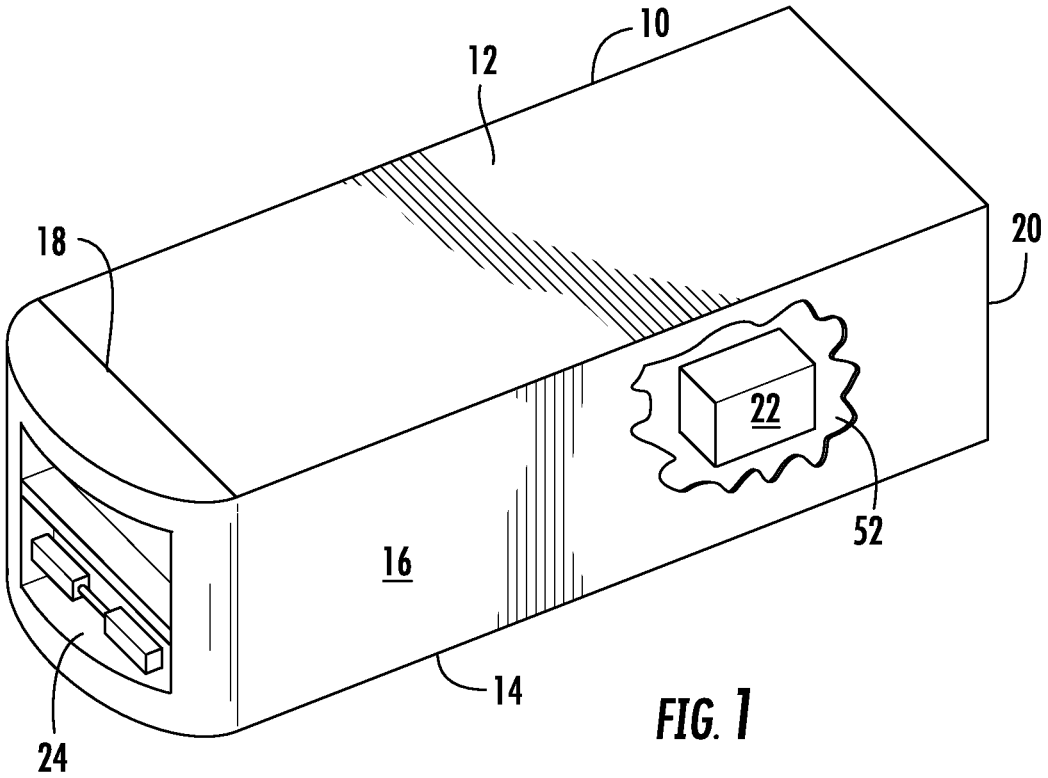
FIG. 1 is a schematic illustration of an embodiment of a refrigerated transportation cargo container.

The detailed description explains embodiments of the invention, together with advantages and features, by way of example with reference to the drawing.

DETAILED DESCRIPTION OF THE INVENTION

Figure 2:
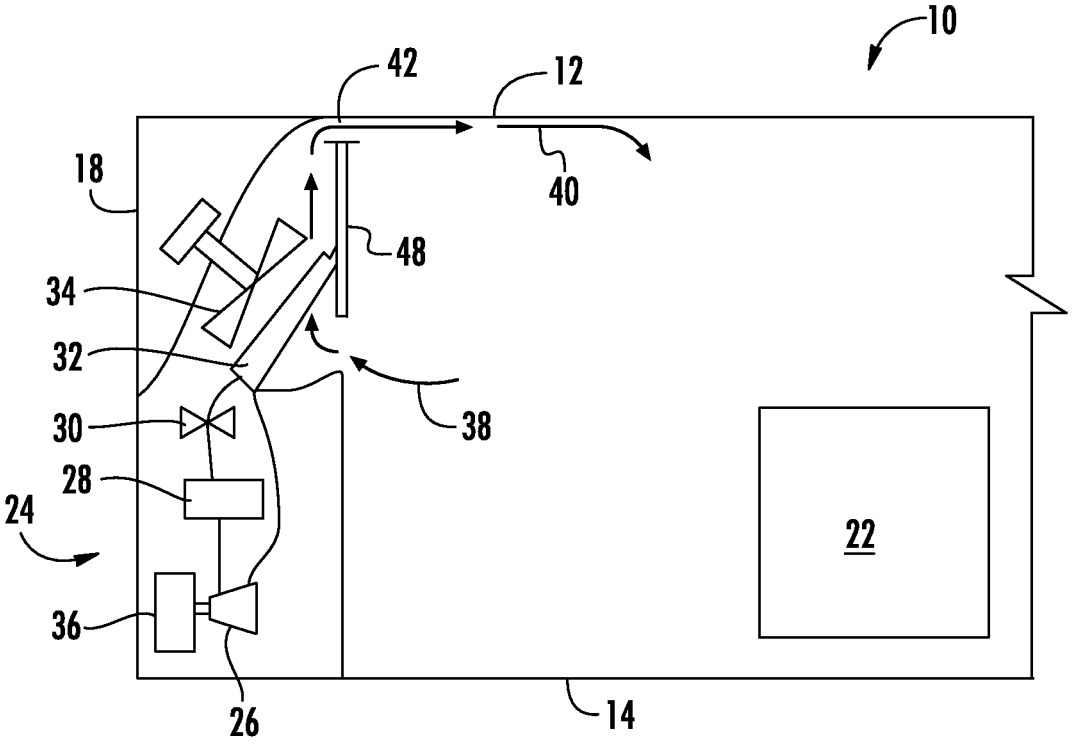
FIG. 2 is a schematic illustration of an embodiment of a refrigeration unit for a refrigerated transportation cargo container.

Shown in FIG. 1 is an embodiment of a refrigerated cargo container 10. The cargo container 10 is formed into a generally rectangular construction, with a top wall 12, a directly opposed bottom wall 14, opposed side walls 16 and a front wall 18. The cargo container 10 further includes a door or doors (not shown) at a rear wall 20, opposite the front wall 18. The cargo container 10 is configured to maintain a cargo 22 located inside the cargo container 10 at a selected temperature through the use of a refrigeration unit 24 located at the container 10. The cargo container 10 is mobile and is utilized to transport the cargo 22 via, for example, a truck, a train or a ship. The refrigeration unit 24 is located at the front wall 18, and includes a compressor 26, a condenser 28, an expansion valve 30, an evaporator 32 and an evaporator fan 34 (shown in FIG. 2). The compressor 26 is operably connected to an engine 36 which drives the compressor 26. The engine is connected to the compressor in one of several ways, such as a direct shaft drive, a belt drive, one or more clutches, or via an electrical generator. Referring to FIG. 2, return airflow 38 flows into the refrigeration unit 24 from the cargo container 10 through a refrigeration unit inlet 60, and across the evaporator 32 via the evaporator fan 34, thus cooling the return airflow 38 to a selected temperature. The cooled return airflow 38, now referred to as supply airflow 40 is then supplied into the container 10 through a refrigeration unit outlet 42, which in some embodiments is located near the top wall 12 of the cargo container 10. The supply air 40 cools the cargo 22 in the cargo container 10. It is to be appreciated that the refrigeration unit 24 can further be operated in reverse to warm the cargo container 10 when, for example, the outside temperature is very low.

The evaporator 32 and evaporator fan 34 are segregated from the remaining components and from the cargo 22 by an inner panel 48 to reduce undesired heating of the evaporator 32 and return airflow 38 by radiant heat from, for example, the condenser 28 and the engine 36. The inner panel 48 is formed from, for example, a sheet metal forming or molding process and is secured to the front wall 18 of the container 10.

Figure 3:
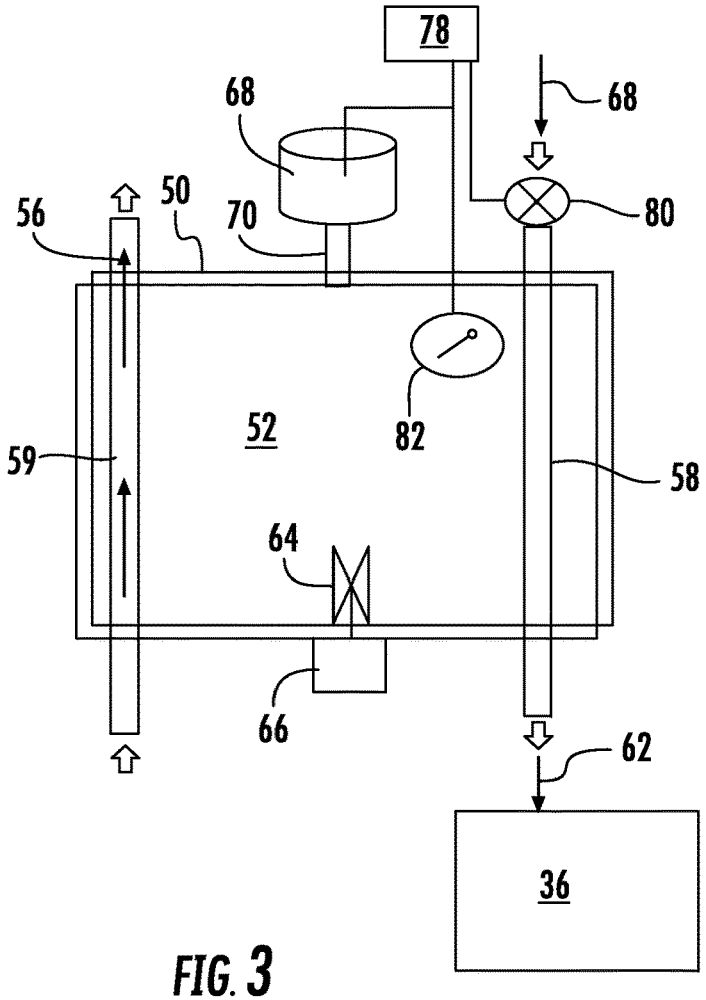
FIG. 3 is a schematic illustration of an embodiment of a regeneration heat exchanger for a refrigeration unit of a refrigerated transportation cargo container.

Referring now to the schematic of FIG. 3, liquefied natural gas (LNG) is utilized as a fuel source for the engine 36, and is regenerated into gaseous methane at a regeneration heat exchanger 50, separate and distinct from the condenser 28, evaporator 32 or other heat exchangers of the refrigeration unit 24. In some embodiments, the regeneration heat exchanger 50 is located between the condenser 28 and the expansion valve 30. The regeneration heat exchanger 50 includes a volume of heat exchange medium 52, for example a fluid coolant such as glycol. It is to be appreciated, however, that other heat exchange mediums, including gasses or phase-change mediums may be utilized in the regeneration heat exchanger 50. The regeneration heat exchanger 50 includes a refrigerant line, or refrigerant coil 54, passing there through to convey a flow of refrigerant 56 from the condenser 28, through the regeneration heat exchanger 50 and to the expansion valve 30. The regeneration heat exchanger 50 further includes a fuel line, or fuel coil 58, passing there through to convey a flow of liquid fuel 60 into the regeneration heat exchanger 50, and a flow of gaseous fuel 62 out of the regeneration heat exchanger 50. In operation, the flow of refrigerant 56 flows from the refrigeration unit 24 through the refrigerant coil 54 and through the regeneration heat exchanger 50, transferring thermal energy to the heat exchange medium 52. The fuel coil 58 conveys the flow of liquid fuel 60 into the regeneration heat exchanger 50 where, via thermal energy exchange with the heat exchange medium 52, it is gasified. The heat exchange medium 52 facilitates thermal energy exchange between the flow of refrigerant 56 and the flow of liquid fuel 60, while also providing a physical barrier to segregate the flow of refrigerant 56 from the flow of liquid fuel 60. The flow of gaseous fuel 62 then is flowed out of the fuel coil 58 to the engine 36.

In some embodiments, the heat exchange medium 52 is agitated or stirred in the regeneration heat exchanger 50 to increase uniformity of a temperature of the heat exchange medium 52. To accomplish this, an impeller 64 is located in the regeneration heat exchanger 50 and driven by an impeller motor 66.

Leakage of fuel from the fuel coil 58 into the regeneration heat exchanger 50 can potentially contaminate the flow of refrigerant 56, and therefore possibly cause fuel to be introduced into the cargo or passenger compartment thus creating a fire or explosion hazard. To prevent such hazards and to detect leakage of fuel into the regeneration heat exchanger 50, the regeneration heat exchanger 50 includes a fuel separator 68 located at or near a top extent of the regeneration heat exchanger 50. Any fuel leaking from the fuel coil 58 is gasified by the heat exchange medium 52 and rises into the fuel separator 68 through a separator inlet 70, along with expanding heat exchange medium 52.

Figure 4:
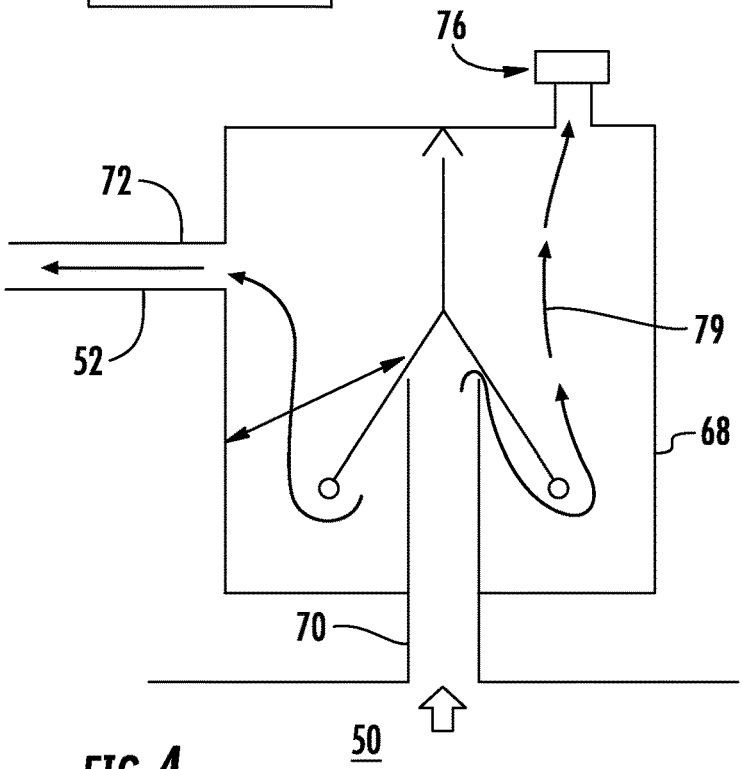
FIG. 4 is across-sectional view of an embodiment of a fuel separator for a regeneration heat exchanger of a refrigeration unit of a refrigerated transportation cargo container.

Referring now to FIG. 4, excess heat exchange medium 52 flows out of the fuel separator 68 into an overflow line 72, while gasified fuel 74 flows into methane detector 76. When the methane detector 76 detects gasified fuel 74, a signal is sent from the methane detector to a controller 78, shown in FIG. 3, which in turn signals a fuel control valve 80 to close and stop the flow of liquid fuel 60 through the fuel coil 58 thus shutting the engine 36 off and preventing further leakage of fuel. Further, the regeneration heat exchanger 50 includes a pressure and/or temperature transducer 82 which detects temperature and/or pressure of the heat exchange medium 52 in the regeneration heat exchanger 50. The temperature and/or pressure are compared to thresholds either at the transducer 82 or another location, for example, the controller 78. If an overpressure or over temperature or under temperature condition is detected by the transducer 82 from, for example, a clogged fuel separator 68, the controller 78 signals for closure of the fuel control valve 80 to stop the flow of liquid fuel 60 through the fuel coil 58. The closure of the fuel control valve 80 stops the flow of liquid fuel 60 thereby stopping leakage of the fuel into the heat exchange medium 52. This in turn stops fuel supply to the engine 36 stopping engine 36 operation. Once the engine 36 operation has stopped, the compressor 26 no longer circulates refrigerant through the refrigeration unit 24 and thus is an additional protection against fuel entering the passenger compartment and/or the cargo compartment.

Use of the flow of refrigerant 56 and the regeneration heat exchanger 50 to convert the flow of liquid fuel 60 into the flow of gaseous fuel 62 provides several benefits to the refrigeration unit 24. It effectively utilizes "waste heat" from the refrigeration unit 24, heat that would otherwise be dissipated to ambient, to provide work in the form of gasifying the flow of liquid fuel 60. The flow of liquid fuel 60, on the other hand, cools the flow of refrigerant 56 via the regeneration heat exchanger 50, resulting in additional cooling capacity of the refrigeration unit 24. The system disclosed herein further provides structure and method for detection of gasified fuel 74 in the regeneration heat exchanger 50 indicative of a leak in the fuel coil 58. Finally, the structure assures there is not direct path for contamination of the flow of liquid refrigerant 56 by fuel due to the heat exchange medium 52.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A refrigeration unit, comprising:

a refrigeration unit to provide a flow of supply air for a conditioned space, the refrigeration unit having a flow of refrigerant flowing therethrough and including:

a compressor;

a condenser fluidly connected to the compressor;

an engine powered by a flow of fuel and operably connected to the compressor to drive the compressor; and a regeneration heat exchanger separate and distinct from the condenser to gasify the flow of fuel prior to the flow of fuel entering the engine via a thermal energy exchange with the flow of refrigerant flowing from the condenser through the regeneration heat exchanger, the regeneration heat exchanger including a volume of heat exchange medium to facilitate thermal energy exchange between the flow of fuel and the flow of refrigerant and to provide physical separation of the flow of refrigerant from the flow of fuel, the regeneration heat exchanger including:

a refrigerant line through which the flow of refrigerant is conveyed from the condenser, through the regeneration heat exchanger and toward an expansion valve of the refrigeration unit; and a fuel line configured to convey the flow of fuel into the regeneration heat exchanger as a liquid and convey the flow of fuel out of the regeneration heat exchanger as a gas; and a fuel separator operably connected to the regeneration heat exchanger to separate the flow of fuel from the heat exchange medium, the fuel separator including:

a separator inlet to admit heat exchange medium and gasified fuel;

an overflow line to flow excess heat exchange medium out of the fuel separator; and a methane detector configured to detect the presence of gasified fuel at the fuel separator.

2. The refrigeration unit of claim 1, wherein the flow of fuel is liquefied natural gas.

3. The refrigeration unit of claim 1, further comprising one or more of a temperature sensor or a pressure sensor disposed at the regeneration heat exchanger.

4. The refrigeration unit of claim 1, further comprising a controller operably connected to the methane detector, the controller operably connected to a fuel control valve.

5. The refrigeration unit of claim 4, wherein the controller signals for closure of the fuel control valve if the methane detector detects the flow of fuel at the fuel separator, thereby stopping the flow of fuel through the regeneration heat exchanger.

6. The refrigeration unit of claim 1, further comprising an impeller disposed at the regeneration heat exchanger configured to agitate the heat exchange medium at the regeneration heat exchanger.

7. A method of operating a refrigeration unit comprising:

operably connecting an engine to a compressor of the refrigeration unit;

flowing a flow of refrigerant through a condenser of the refrigeration unit;

directing the flow of refrigerant from the condenser through a regeneration heat exchanger separate and distinct from the condenser via a refrigerant line configured to convey the flow of refrigerant from the condenser, through the regeneration heat exchanger and toward an expansion valve of the refrigeration unit;

flowing a flow of liquid fuel through the regeneration heat exchanger via a fuel line;

gasifying the flow of fuel at the regeneration heat exchanger via a thermal energy exchange with the flow of refrigerant via a heat exchange medium disposed in the regeneration heat exchanger;

directing the gasified flow of fuel to the engine to power the engine via the fuel line;

admitting heat exchange medium and gasified fuel into a fuel separator at a separator inlet;

separating the flow of fuel from the heat exchange medium at the fuel separator;

flowing excess heat exchange medium out of the fuel separator via an overflow line; and detecting the presence of gasified fuel at the fuel separator via a methane detector disposed at the fuel separator.

8. The method of claim 7, wherein detecting the flow of fuel at the fuel separator is indicative of a leak in a fuel coil extending through the regeneration heat exchanger.

9. The method of claim 7, further comprising stopping the flow of fuel into the regeneration heat exchanger when the flow of fuel is detected in the fuel separator.

10. The method of claim 7, further comprising monitoring temperature and/or pressure of the heat exchange medium.

11. The method of claim 10, further comprising stopping the flow of fuel into the regeneration heat exchanger in the case of an overpressure and/or over temperature or under temperature condition of the heat exchange medium.

12. The method of claim 7, wherein the flow of fuel is liquefied natural gas.

* * * * *